US005775314A

United States Patent [19]

Michael et al.

[11] Patent Number: 5,775,314

[45] Date of Patent: Jul. 7, 1998

[54] EASY ACCESS PROTECTIVE ARROW QUIVER

[76] Inventors: Donald E. Michael; Gerald E. Michael, both of 2253 Meadowbrook, Walled Lake, Mich. 48390

[21] Appl. No.: 806,283

[22] Filed: Feb. 25, 1997

[51] Int. Cl.[6] ..... F41B 5/06

[52] U.S. Cl. ..... 124/86; 124/25.7; 224/916

[58] Field of Search ..... 124/25.5, 25.7, 124/86; 224/916

[56] References Cited

U.S. PATENT DOCUMENTS

| | | | |
|---|---|---|---|
| D. 248,040 | 5/1978 | Stinson | D22/107 |
| 2,771,620 | 11/1956 | Hoffman | 206/315.11 |
| 2,781,808 | 2/1957 | Barnard | 224/626 |
| 2,956,603 | 10/1960 | Maule | 221/69 |
| 2,980,305 | 4/1961 | Reese | 124/25.7 |
| 2,984,277 | 5/1961 | Neff | 206/315.11 |
| 3,116,730 | 1/1964 | Tingley | 224/916 X |
| 3,366,232 | 1/1968 | Elfstrom et al. | 206/315.11 |
| 3,716,174 | 2/1973 | Ehlert | 124/25.7 X |
| 3,777,734 | 12/1973 | Rose | 124/25.5 |
| 4,252,101 | 2/1981 | Spitzke | 224/916 X |
| 4,635,611 | 1/1987 | Priebe | 124/25.7 |
| 4,788,961 | 12/1988 | Toth | 124/25.5 |
| 5,358,108 | 10/1994 | Celaya | 206/315.11 |
| 5,409,109 | 4/1995 | Smith | 206/315.11 |

*Primary Examiner*—John A. Ricci

*Attorney, Agent, or Firm*— Gifford,Krass,Groh,Sprinkle, Patmore,Anderson&Citkowski

[57] ABSTRACT

An easy access arrow quiver is removably mountable to a bow. A hollow, elongated, generally cylindrical enclosure features an elongated, longitudinally oriented aperture through which arrows may be inserted and removed. A rotatable rod disposed centrally within the enclosure includes a pair of spaced-apart arrow-retainment disks, each having a shaped perimeter defining a plurality of circumferentially spaced apart arrow-shaft retainment clips, the disks being rotationally positioned respectively about the rod so that the clips on each disk are longitudinally aligned. A coupling unit, which has a first portion making physical connection to the enclosure and a second portion which attaches to the bow, permits the enclosure to be removably mounted to the bow such that the longitudinal dimension of the enclosure and the aperture are generally parallel to the drawstring of the bow. The quiver may further include a handle supported on the outer surface of the enclosure, and, in this configuration, the first portion of the coupling unit preferably makes physical connection to the enclosure by way of the handle. As a further option, the centralized rod attaches to a pair of opposing endcaps, each endcap engaging with a respective end of the enclosure and extending sufficiently outwardly therefrom to enable a user to rotate the rod by turning either of the endcaps.

5 Claims, 2 Drawing Sheets

EASY ACCESS PROTECTIVE ARROW QUIVER

FIELD OF THE INVENTION

This invention relates generally to the field of archery and, in particular, to a protective arrow quiver which may be releasably mounted onto a hunting bow to provide easy access to a carousel of arrows supported within.

BACKGROUND OF THE INVENTION

Bow hunters are faced with the conflicting requirement of having arrows readily available yet protected from harm during foot travel, for example. Some bow mountable arrow-carrying appliances are available but typically these do not fully protect the arrows or, the arrows are mounted in such a way that their points may be damaged or the arrows difficult to remove.

The need remains for a quiver applicable to hunting which facilitates both easy access and enclosed arrow protection. Some attempts to address this need have been made, but all of the devices so far proposed present drawbacks in terms of deployment. In U.S. Pat. No. 2,956,603 to Maule entitled HUNTING QUIVER, for example, a cylindrical housing is provided with a rod concentrically supported therewithin for rotational movement and, secured to a lower portion of the rod is a cylindrical drum having a plurality of circumferentially spaced apart pairs of spring clips for releasably supporting arrows. The side wall of the housing is provided with an elongated axis opening which is in registry with each arrow carried on the drum as the drum is rotated. Unfortunately, this quiver contains no mechanism, nor does this patent suggest mounting to a bow, but rather, provides a pair of straps secured to the exterior side of the housing so that it may be carried, for example, over the arm of the user. Additionally, the hunting quiver of Maule does not enable a user to conveniently rotate the arrow-carrying carousel, but instead, provides an unnecessarily complicated ratchet mechanism which forces the user to take the arrows out in a predetermined sequence and replace them in the opposite sequence, thereby limiting flexibility.

Another prior-art example of an enclosed quiver may be found in U.S. Pat. No. 2,984,277 to Neff entitled ROTO-QUIVER. This invention includes a cylindrical case with a continuous slot through which arrows may be inserted and retrieved, and a concentric, rotatable shaft including a pair of arrow-retaining disks which are formed of relatively stiff sponge rubber or suitable material. Arrows are inserted through the opening and wedged into the disk with the lower ends or points of the arrows resting on the lower disk spaced above a base, facilitating a manual rotation for arrow alignment respecting the axis opening. Again, however, this device provides for a shoulder strap as opposed to bow mounting, and its arrow-retaining disks appear to be inadequate to the task. In addition, the points of the arrows according to this disclosure are preferably urged against a rotating base, which may result in damage to the arrows, to the base, or the both, and may complicate arrow removal in time of need.

SUMMARY OF THE INVENTION

The present invention improves upon existing arrow quivers by providing an easy access configuration which is removably mountable to a bow. In a preferred embodiment, a quiver according to the invention includes a hollow, elongated, generally cylindrical enclosure having an outer surface and two, spaced-apart ends defining a length somewhat longer than an arrow of the type used in archery. The enclosure in turn provides an elongated, longitudinally oriented aperture through which arrows may be inserted into, and removed from, the enclosure. A rotatable rod is disposed centrally within the enclosure, and includes a pair of spaced-apart arrow-retainment disks attached to the rod such that the rod extends centrally therethrough each, the diameter of each disk being dimensioned to permit rotation of the rod and attached disks within the enclosure. Each disk features a shaped perimeter defining a plurality of circumferentially spaced apart arrow-shaft retainment clips, the disks being rotationally positioned respectively about the rod so that the clips on each disk are longitudinally aligned. A coupling unit, which has a first portion making physical connection to the enclosure and a second portion which attaches to the bow, permits the enclosure to be removably mounted to the bow such that the longitudinal dimension of the enclosure and the aperture are generally parallel to the drawstring of the bow.

The quiver may further include a handle supported on the outer surface of the enclosure, and, in this configuration, the first portion of the coupling unit preferably makes physical connection to the enclosure by way of the handle. As a further option, the centralized rod attaches to a pair of opposing endcaps, each endcap engaging with a respective end of the enclosure and extending sufficiently outwardly therefrom to enable a user to rotate the rod by turning either of the endcaps. With respect to the arrow-shaft retainment clips, each preferably features an arrow-shaft receiving slot bounded on either side by a pair of resilient members, each member being coupled to respective portions of the disk with which they are associated by way of a living hinge, each slot defining a width less than the diameter of a typical arrow shaft, such that an arrow to be retained may be forced into a pair of the longitudinally aligned individual arrow retainer clips by pressing a portion of the arrow shaft proximate to each clip into a respective slot, with the living hinges in each case expanding then resiliently contracting to hold the arrow in place.

DETAILED DESCRIPTION OF THE PREFERRED EMBODIMENT

Figure 1:
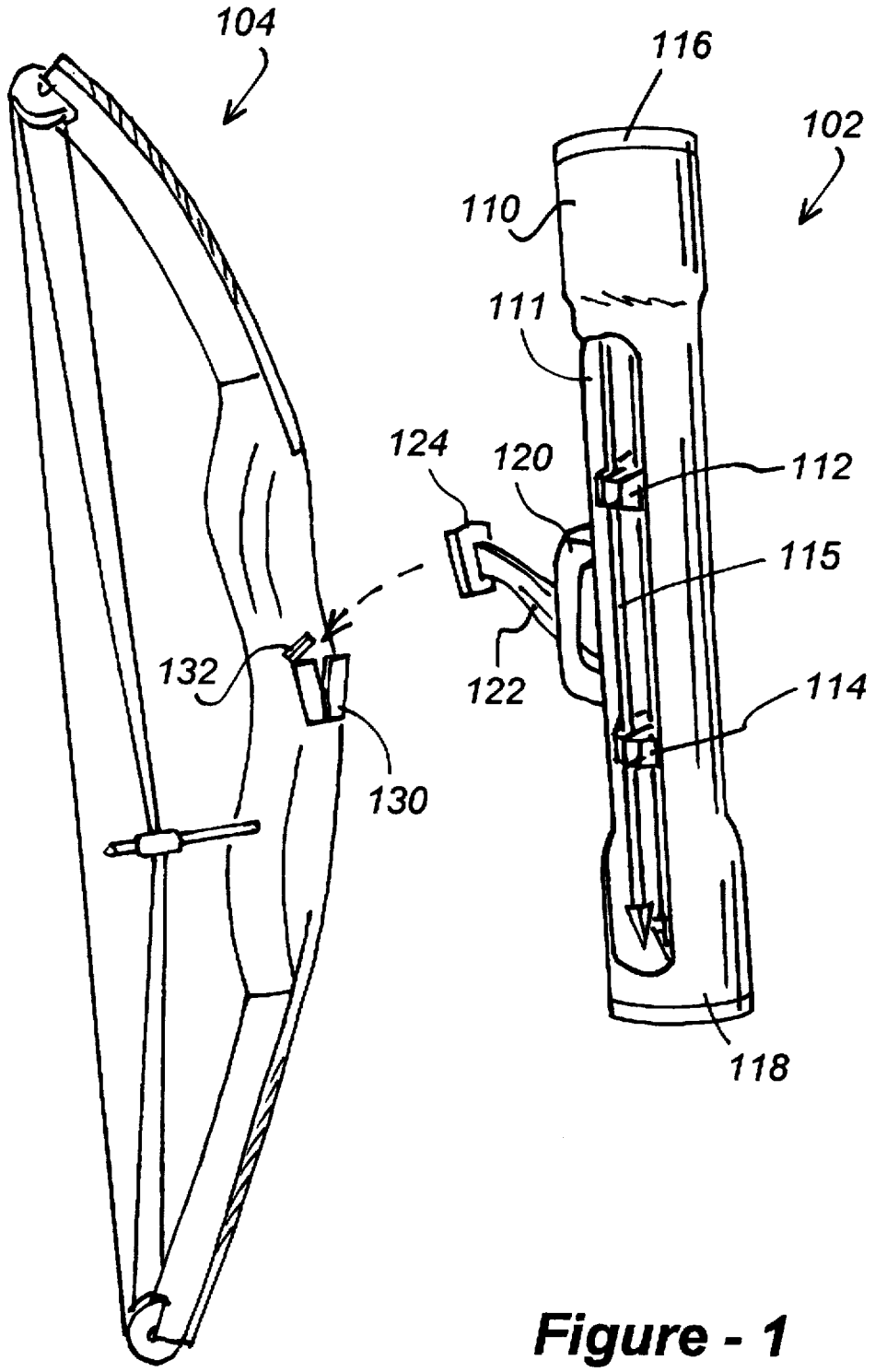
FIG. 1 illustrates, from an oblique perspective, an embodiment of a bow-mountable quiver according to the invention.

Now making reference to the drawings, there is shown in FIG. 1 an easy access protective arrow quiver according to the invention generally at 102, which preferably includes means described below for attaching to a bow 104. It should be noted that although a compound bow is depicted in the figure, the invention is equally applicable to other types of bows and/or archery-related equipment, and that the physical configurations in the figures may or may not be to scale.

The inventive quiver 102 includes an enclosure 110, which is preferably cylindrical, and may flare out to a larger diameter at the top and bottom, as shown. Along one side of this enclosure 110, there is found an elongated aperture 111 through which arrows such as 115 may be inserted into and drawn from the enclosure. As will become more clear with regard to subsequent figures, the arrows such as 115 are retained in at least two places with an upper arrow-retaining mechanism 112 and a like lower mechanism 114. These arrow-retaining mechanisms are disposed onto a central, rotatable shaft, not visible in FIG. 1, which is preferably further coupled to an upper end cap 116 and a lower end cap 118 which, along with internal portions of the resulting carousel assembly, may be manually turned, so as not to align a particular arrow or pair of retaining mechanisms with the aperture 111.

Along a side of the enclosure 110 and spaced apart from the aperture 111, there may be included a carrying handle 120 to which there is attached an arm 122 and a mounting feature 124 which, as shown with the broken arrow, slides into a retaining feature 130 mounted onto the side of the bow 104. It should be apparent that the length of the arm 122 may be varied depending upon the circumstances, and that other releasble mounting apparatus may be used according to the invention. Once the element 124 is slid into the bracket 130, a spring-loaded clasp 132 may be provided to guard against inadvertent dislocation.

Figure 2:
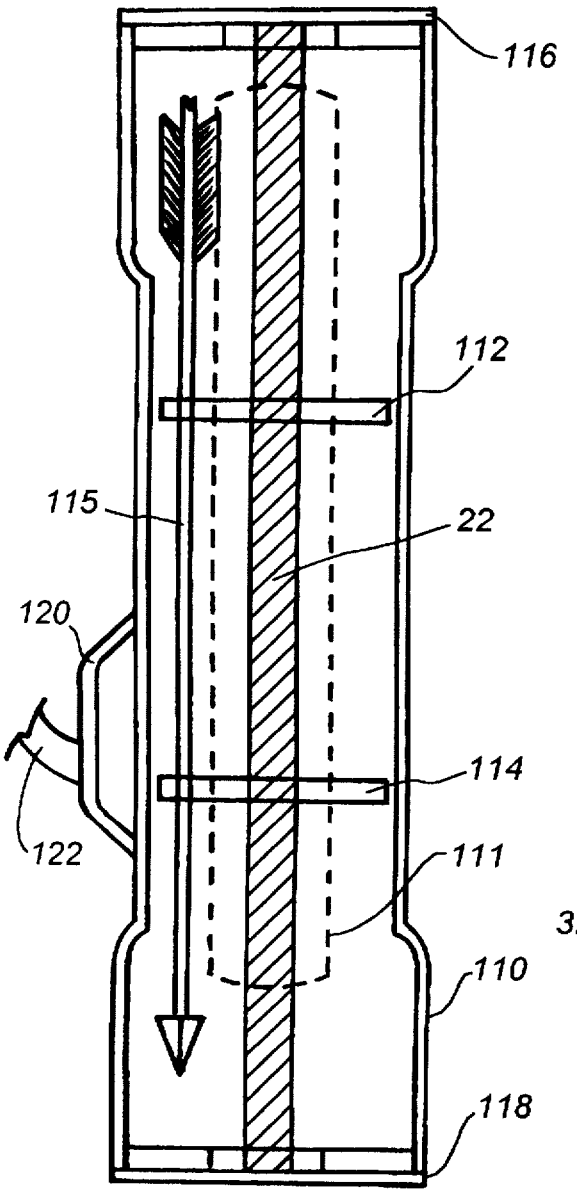
FIG. 2 is a cross-section of the device of FIG. 1.

FIG. 2 provides, in partial cross-section, a side-view illustration of an easy-access arrow quiver according to the invention. Again, it should be kept in mind that this particular drawing is not necessarily to scale. In FIG. 2, one can see how the pair of arrow-retainment mechanisms 112 and 114 are spaced apart along a central rotatable rod 22 which, as mentioned above, is preferably bonded to upper and lower end caps 116 and 118, respectively.

Figure 3:
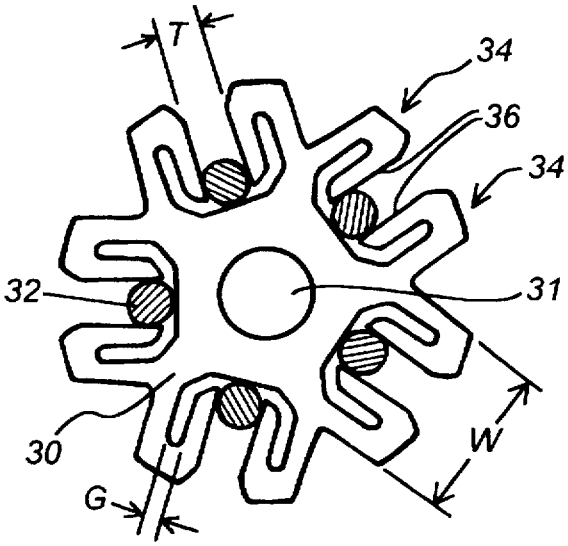
FIG. 3 is a plan view of a preferred arrow-retaining mechanism having a circular design.

FIG. 3 better illustrates the preferred design of the arrow-retaining mechanisms 112 and 114. According to this aspect of the invention, a plurality of retainment clips are disposed circumferentially around the rod 31 to which the element is bonded, each clip including a pair of outwardly extending arms 34 which are bent back toward one another and toward the rod 31 to create a capture space. For this particular design, which retains five arrows as shown, the width W between the outermost sides of the clips 34 is approximately one inch, and, with a gap G of approximately ⅛ inch, creating a living hinge associated with members 36. This creates a dimension T approximately 5/16 inch, which has been demonstrated to retain commonly available arrows having typical shaft cross-sections.

To insert an arrow, it is pushed into the region T, with the main clip features 34 being slightly pushed apart, but once the arrow has passed the living hinge sections, the members 36 are then pushed apart with the overall features 34 resiliently turning to their original state, now with the elements 36 being provided with a certain level of potential energy to hold the arrow shaft conveniently in place. Such retainment mechanisms may be fabricated from various suitable resilient materials, such as plastics, including PVC, vinyl, polyethylene, polypropylene, and so forth.

Figure 4:
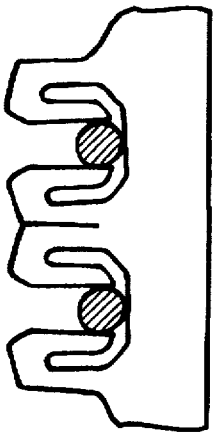
FIG. 4 is an alternative embodiment of an arrow-retaining mechanism according to the invention which may be disposed linearly as opposed to circularly, as in FIG. 3.

It will be clear that the arrow-retainment mechanism of FIG. 3 may be varied to a certain extent to accept more or fewer arrows, or to fit a different geometrical configuration. For example, in FIG. 4, the clips are not circumferentially spaced around a rod 31, but rather, are linearly disposed, a configuration which may be suitable for quivers not having a rotatable arrow-retaining carousel of the type described above.

Having thus described my invention, we claim:

1. An arrow quiver mountable to a bow having a drawstring, comprising:

a hollow, elongated, generally cylindrical enclosure having an outer surface and two, spaced-apart ends defining a length somewhat longer than an arrow of the type used in archery, the enclosure including an elongated, longitudinally oriented aperture through which arrows may be inserted into, and removed from, the enclosure;

a rotatable rod disposed centrally within the enclosure, including a pair of spaced-apart arrow-retainment disks attached to the rod such that the rod extends centrally therethrough each, the diameter of each disk being dimensioned to permit rotation of the rod and attached disks within the enclosure, each disk featuring a shaped perimeter defining a plurality of circumferentially spaced apart arrow-shaft retainment clips, the disks being rotationally positioned respectively about the rod so that the clips on each disk are longitudinally aligned;

a coupling unit having a first portion making physical connection to the enclosure and a second portion which attaches to the bow, the coupling unit permitting the enclosure to be removably mounted to the bow such that the longitudinal dimension of the enclosure and the aperture are generally parallel to the drawstring of the bow; and a handle supported on the outer surface of the enclosure, and wherein:

the first portion of the coupling unit makes physical connection to the enclosure by way of the handle.

2. The arrow quiver of claim 1, wherein:

the handle includes a surface furtherest away from the outer surface of the enclosure, and the first portion of the coupling unit makes physical connection to the surface of the handle furtherest away from the outer surface of the enclosure.

3. The arrow quiver of claim 1, wherein:

the rod attaches to a pair of opposing endcaps, each endcap engaging with a respective end of the enclosure and extending sufficiently outwardly therefrom to enable a user to rotate the rod by turning either of the endcaps.

4. The arrow quiver of claim 1, wherein:

each arrow-shaft retainment clip features an arrowshaft receiving slot bounded on either side by a pair of resilient members, each member being coupled to respective portions of the disk with which they are associated by way of a living hinge, each slot defining a width less than the diameter of a typical arrow shaft, such that an arrow to be retained may be forced into a pair of the longitudinally aligned individual arrow retainer clips by pressing a portion of the arrow shaft proximate to each clip into a respective slot, with the living hinges in each case expanding then resiliently contracting to hold the arrow in place.

5. A bow-mountable arrow quiver, comprising:

a hollow, elongated, generally cylindrical enclosure having an outer surface and two, spaced-apart ends defining a length somewhat longer than an arrow of the type used in archery, the enclosure including an elongated, longitudinally oriented aperture through which arrows may be inserted into, and removed from, the enclosure;

a coupling unit disposed on the outer surface of the enclosure, enabling the enclosure to be removably mounted to an archery bow such that the longitudinal dimension of the enclosure and the aperture are generally parallel to the drawstring of the bow;

a rotatable elongated member attached to a pair of opposing endcaps, each endcap engaging with a respective end of the enclosure and extending sufficiently outwardly therefrom to enable a user to rotate the elongated member by turning either of the endcaps;

a pair of arrow-retainment devices attached to the elongated member in spaced-apart fashion with the elongated member extending centrally therethrough, each device taking the form of a generally circular disk, the diameter of each disk being dimensioned to permit rotation of the elongated member within the enclosure having the disks attached thereto, each disk featuring a shaped perimeter defining a plurality of circumferentially spaced apart arrow-shaft retainment clips, the disks being rotationally positioned such that the clips on each disk are longitudinally aligned, each clip including an arrow-shaft receiving slot bounded on either side by a pair of resilient members, each member being coupled to respective portions of the disk with which they are associated by way of a living hinge, each slot defining a width less than the diameter of a typical arrow shaft, such that an arrow to be retained may be forced into a pair of the longitudinally aligned individual arrow retainer clips by pressing a portion of the arrow shaft proximate to each clip into a respective slot, with the living hinges in each case expanding then resiliently contracting to hold the arrow in place.

* * * * *